United States Patent [19]

Ogura et al.

[11] 4,370,389

[45] Jan. 25, 1983

[54] COATED PAPER OF IMPROVED PRINTABILITY

[75] Inventors: Toshimasa Ogura, Tokyo; Yasunosuke Sakai, Funabashi, both of Japan

[73] Assignee: Mitsubishi Paper Mills, Ltd., Tokyo, Japan

[21] Appl. No.: 252,803

[22] Filed: Apr. 10, 1981

[30] Foreign Application Priority Data

Apr. 16, 1980 [JP] Japan ..... 55-50128

[51] Int. Cl.[3] ..... B32B 27/08

[52] U.S. Cl. ..... 428/511; 162/136; 162/135; 427/361; 427/391; 428/512; 428/514; 524/461; 525/314

[58] Field of Search ..... 428/511, 507, 517, 509; 427/361, 391; 162/136, 135; 524/461; 525/314

[56] References Cited

U.S. PATENT DOCUMENTS

| | | | |
|---|---|---|---|
| 2,759,847 | 8/1956 | Frost et al. | 427/362 |
| 3,377,192 | 4/1968 | Kirk et al. | 427/362 |
| 4,265,977 | 5/1981 | Kawamura | 428/511 |

*Primary Examiner*—George F. Lesmes
*Assistant Examiner*—E. Rollins Buffalow
*Attorney, Agent, or Firm*—Cushman, Darby & Cushman

[57] ABSTRACT

A coated paper having a high paper gloss and a surface strength sufficient enough for practical purposes is obtained by coating a base paper sheet with an aqueous coating composition comprising a paper-coating pigment and a latex of styrene-butadiene copolymer or modified styrene-butadiene copolymer, the styrene block of which includes 8 to 40 monomeric units, drying the wet coated sheet, and subjecting the coated side to hot calendering treatment.

13 Claims, No Drawings

COATED PAPER OF IMPROVED PRINTABILITY

This invention relates to a coated paper excellent in printability.

For the production of cast-coated papers, there have been known processes including (1) a wet casting method in which the wet coating layer is dried while being pressed against a heated smooth finishing surface (e.g. Japanese patent publication No. 25,160/1963); (2) a rewet casting method which comprises first drying the wet coating layer, then plasticizing the dried layer by rewetting, and again drying the layer while being pressed against a heated smooth finishing surface (e.g. U.S. Pat. No. 2,759,847); and (3) a gel casting method, according to which the wet coating layer is transformed to a gel state and dried while being pressed against a heated smooth finishing surface (e.g. Japanese patent publication No. 15,751/1963; U.S. Pat. No. 3,377,192). These methods are based on the common principle that the coating layer comprising a mineral pigment and a binder as major components is dried by pressing against a heated finishing surface while the wet coating layer remains in a plastic state. Since it is necessary to dry the wet coating layer, while being pressed against a finishing surface until it becomes non-plastic, the production rate in actual practice becomes as low as one over several tens of that of customary pigment-coated paper.

There is also known a process for the high-speed production of pigment-coated papers having a high gloss by passing, under application of a high pressure, a dry or slightly wet coated paper sheet through the roll nip of a gloss calender or super calender provided with a heated roll or drum. The super calender is operated at a relatively high nip pressure of 200 kg/cm or thereabout and at a finishing steel roll temperature of about 70° C. The finishing of paper surface by the gloss calender is performed by pressing the coated paper against a polished drum surface under the temperature conditions under which the coated side becomes temporarily plastic. The gloss calender is generally operated under pressure conditions (approximately 90 kg/cm in nip pressure) milder than those for a super calender and at a higher temperature of about 150° C.

In the case of the above-noted heated calender, since the gloss and smoothness of the coated surface are obtained by the deformation (plastic deformation) of softened coated layer on application of heat and pressure, it is desirable that the coating layer itself be easily subject to the plastic deformation on application of heat and pressure and, hence, the binder in the coating layer be thermoplastic so that on application of heat and pressure the coating layer may immediately become deformed to acquire a mirror image of the finishing surface of a metal roll or the like, resulting in a good gloss and smoothness of the coated surface. On the other hand, however, the tendency of the coating layer to stick to the finishing roll surface gradually becomes larger and soon the accumulation of minute foreign matters may interrupt the continuous running of the calender. To minimize the stickiness, it has heretofore been a general practice to incorporate the coating composition with release agents such as waxes, fats, fatty acids, soaps, surface active agents, silicone resins, or the like or to apply continuously such agents to the roll surface. The release agent, however, accumulates gradually on the finishing roll surface to form a thin coating of excess release agent, which markedly reduce the gloss of coated papers. Moreover, it is very difficult to control adequately the amount of the release agent to be added. The addition of a large amount of the release agent causes deterioration of the printability. For the above reasons, the addition of a release agent does not always lead to a desirable solution of the problem.

This invention relates to a coated paper having none of the above-said disadvantages, which is obtained by coating a paper sheet with an aqueous coating composition comprising a paper-coating pigment and a latex of a styrene-butadiene copolymer or a modified styrene-butadiene copolymer, the styrene block of which includes 8 to 40, preferably 10 to 30, monomeric units, drying the wet coated sheet, and subjecting the dried coated side to hot calendering treatment. The coated paper of this invention has a high paper gloss and a surface strength sufficient enough for practical purposes, because the heated calender hardly becomes stained during the manufacturing operation.

The latex conventionally used in obtaining a high-gloss paper by hot calendering is that of a thermoplastic polymer having a high glass transition temperature (hereinafter referred to as Tg). As for the styrene-butadiene copolymer latex, a latex of a copolymer having a high styrene content has been known to produce a coated paper of high gloss. When a latex of a copolymer high in styrene content and, hence, in Tg is used, although a high gloss can be obtained, yet it is difficult to obtain a coating layer sufficiently high in strength, unless the coated side undergoes hot calendering treatment at a temperature higher than Tg of the copolymer. However, if the treatment of coated paper is performed at temperatures higher than Tg of the copolymer under severer hot calendering conditions to achieve the improved coating strength, there will be brought about troubles such as staining of the heated calender and impairment of rolls, resulting in marked reduction in the production rate.

If it is attempted to increase the coating layer strength by modifying the composition of latex, it becomes necessary to increase the butadiene content of the copolymer, which leads to deterioration of the gloss.

For the above reasons, it is difficult to improve simultaneously the gloss and surface strength of a coated paper as well as the efficiency of coating operation. The present inventors carried out extensive investigations and, as a result, have achieved the present invention.

The styrene-butadiene copolymer latex and modified styrene-butadiene copolymer latex generally used in coating paper are prepared from styrene, butadiene and acrylic esters as major monomers. The present inventors carried out researches on the composition and structure of styrene-butadiene copolymer and modified styrene-butadiene copolymer to obtain a latex most suitable for the manufacture of high-gloss printing paper. As a result, it was found that although the reason is not clearly known, a latex of a styrene-butadiene copolymer or modified styrene-butadiene copolymer having styrene blocks of 8 to 40, preferably 10 to 20, monomeric units is very useful in coating paper which is to be subjected to hot calendering treatment according to this invention. When a latex of the above-specified copolymer is used, formation of scales on the heated calender roll may be reduced and there is obtained a coated paper higher in surface strength and paper gloss, as compared with coated papers made by use of a latex of conventional copolymers of the identical monomer composition.

Styrene-butadiene copolymers in latex form can contain styrene blocks of heptamer or less repeat units. The number of repeat units in a styrene block is estimated in the following way. The NMR spectrum of a polystyrene or styrene copolymer having styrene blocks of octamer or more repeat units shows two broad absorptions at 7.0 ppm (protons in meta and para positions) and 6.5 ppm (proton in ortho position). It is well known that the resolution into these two peaks becomes more distinct as the styrene block becomes larger. Consequently, by comparing with the degree of peak resolution of the spectrum of a polystyrene with known molecular weight, it is possible to estimate the number of monomeric units in the styrene block under test. In practice, the ratio between integrated values of the two absorption peaks at 6.5 and 7.0 ppm is determined from the NMR spectrum of a standard polystyrene. From a series of such determinations, a calibration curve is drawn to represent the relationship between the molecular weight and the ratio between the integrated values of two peaks. By using the calibration curve, the size of styrene block in any latex may be estimated.

The amount to be added of the latex of a copolymer having styrene blocks of 8 to 40 monomeric units, as determined by the above method, is generally 3 to 30 parts, preferably 5 to 20 parts by weight for 100 parts by weight of the pigment, though not specifically limited.

If the styrene block is smaller than octamer, it is difficult to improve sufficiently the staining of heated calender and hence to improve the paper gloss, resulting in a failure to achieve the object of this invention, whereas if the styrene block contains more than 40 monomeric units, the surface strength of the coated paper becomes inferior. It is preferable that the styrene-butadiene copolymer contains 60 to 90% by weight of styrene units and 10 to 40% by weight of butadiene units. If the proportion of styrene units is below 60% by weight, a sufficient paper gloss is difficult to obtain, whereas if it exceeds 90% by weight, the surface strength of the coated paper becomes inferior. If the proportion of butadiene units is below 10% by weight, the surface strength of the coated paper is insufficient, whereas if it exceeds 40% by weight, a sufficient paper gloss is difficult to obtain.

The term "paper," as herein used, means any of the papers made from wood pulp, hemp pulp, linter, rayon, and synthetic pulps each alone or in mixtures; as well as any of the synthetic papers including nonwoven fabrics. The paper may contain additives such as reinforcing agents.

The modified styrene-butadiene copolymers in the latices used in this invention are those prepared by copolymerization of styrene, butadiene and acrylic or methacrylic esters, the latter esters being preferred. To increase the latex stability, the styrene-butadiene copolymers and modified styrene-butadiene copolymers are frequently incorporated, by chemical reaction, with acid monomers such as, for example, acrylic acid, itaconic acid, and crotonic acid. The styrene-butadiene-methyl methacrylate copolymer contains preferably 55 to 85% by weight of styrene, 10 to 40% by weight of butadiene and 5 to 35% by weight of methyl methacrylate. If the proportion of styrene is below 55% by weight, a sufficient paper gloss is difficult to obtain, while if the proportion of butadiene is below 10% by weight, the surface strength is insufficient.

The pigments used in the coating composition of this invention include clay, kaolin, aluminum hydroxide, calcium carbonate, titanium oxide, barium sulfate, zinc oxide, satin white, and other inorganic pigments, and mixtures of inorganic pigments and plastic pigments.

The styrene-butadiene copolymer latex or modified styrene-butadiene copolymer latex can be used together with binders for use in general coated papers, which include casein, soybean protein, starches such as phosphorylated starch and oxidized starch, cellulose derivatives such as carboxymethylcellulose and hydroxyethylcellulose, latices of conventional conjugated diene copolymers such as styrene-butadiene copolymer and methyl methacrylate-butadiene copolymer, latices of acrylic polymers such as acrylic ester polymers and methacrylic ester polymers, latices of vinyl polymers such as ethylene-vinyl acetate copolymers, latices of various polymers modified with monomers containing functional groups such as carboxyl group, PVA, and thermosetting synthetic resin binders for coated papers such as olefin-maleic anhydride resins and melamine resin. If required for the quality of the finished high-gloss papers, other additives such as defoamers, coloring agents, and fluidity modifiers can be added so far as the characteristics of the coated paper are not impaired.

The coating composition of this invention may be applied by means of coating equipments generally used for pigment-coated papers, such as blade coater, air knife coater, roll coater, brush coater, curtain coater, Champflex coater, bar coater, and gravure coater. In view of mirror-like finished surface, blade coater is especially preferred. The application rate is generally 10 to 40 g/m$^2$, preferably 10 to 30 g/m$^2$ on air dry base.

The drying subsequent to the coating is performed by use of various heating means such as gas heater, electric heater, steam heater, and hot air heater.

The invention is illustrated below with reference to Examples, but the invention is not limited thereto. In Examples, all parts and percentages are by weight.

In Examples, physical properties were tested in the following manner:

(1) Paper gloss: 75° and 20° specular gloss (in %) were measured by means of a gloss tester (Nippon Rigaku Co.).

(2) Ink gloss: After printing with RI printability tester (Akira Seisakusho Co.) and drying, 60° specular gloss (in %) was measured by means of a gloss tester (Nippon Rigaku Co.).

(3) Smoothness: measured by means of a smoothness tester ("Smoothter" of Toei Denki Kogyo Co.) (in mmHg).

(4) Stain on gloss calender (formation of calender scales): Degree of formation of scales on the gloss calender due to sticking of the coating composition was visually evaluated.

o no scales; x considerable scales and unsuitable for practical use. Scales increase in the order o < Ⓐ < ▲ < x < x.

(5) Surface strength of coated paper: evaluated by means of RI printability tester (Akira Seisakusho Co.).

Dry: The test specimen was printed with an ink of known tack and the surface of specimen was visually evaluated.

Wet: Immediately after applying a little water to the specimen surface, the specimen was printed with an ink of known tack and the surface was visually evaluated. The surface strength decreases in the order 5>4>3>2>1.

EXAMPLE 1

A pigment mixture comprising 90 parts of kaolin and 10 parts of precipitated calcium carbonate was dispersed in water with 0.1 part of sodium polyacrylate to prepare a pigment dispersion of 71% solid content. To the pigment dispersion were added 2 parts of oxidized starch and 15 parts of one of the 7 modified styrene-butadiene copolymer latices and 7 styrene-butadiene copolymer latices, shown in Table 1. The mixture was thoroughly stirred to obtain a coating composition of 62% solid content. In the same manner, a total of 14 coating compositions were prepared. In the column "Styrene block" of Table 1, "≦Heptamer" means that as previously described, the NMR absorption peaks of phenyl radical protons of styrene at 7.0 ppm (protons in meta and para positions) and at 6.5 ppm (proton in ortho position) do not show resolution.

The above 14 coating compositions were each coated by means of a blade coater on a base paper sheet, 78 g/m² in basis weight, at an application rate of 17 g/m² on dry basis and dried in an air cap drier at an air current temperature of 120° C. After drying, the coated sheet was subjected to gloss calendering treatment under the conditions: nip pressure, 80 kg/cm; surface temperature, 130° C.; calender speed, 120 m/minute. The properties of 14 coated paper sheets thus obtained were as shown in Table 1.

As is apparent from Table 1, coated paper sheets No. 1 and No. 8 prepared by using respectively a modified styrene-butadiene copolymer and styrene-butadiene copolymer each having styrene blocks of heptamer or below (i.e. no resolution of absorption peaks) showed a low paper gloss and considerable build-up of stain on gloss calender; and coated paper sheets No. 7 and No. 14 prepared by using respectively a modified styrene-butadiene copolymer and styrene-butadiene copolymer each having styrene blocks larger than 40 monomeric units showed a low ink gloss and are inferior in both dry and wet surface strengths. To the contrary, coated paper sheets Nos. 2 to 6 and 9 to 13 according to this invention showed a high paper gloss, high ink gloss, low build-up of stain on gloss calender, and a surface strength sufficient for practical uses.

TABLE 1

| Sample No. | Proportion of each constituent in copolymer (% by weight) | | | Styrene block | Coated Paper | | | | | | | Remarks |
|---|---|---|---|---|---|---|---|---|---|---|---|---|
| | Styrene | Butadiene | Methyl methacrylate | | Paper gloss (%) 75° | Paper gloss (%) 20° | Ink gloss (%) | Surface strength Dry | Surface strength Wet | Smoothness (mmHg) | Stain on gloss calender | |
| 1 | 63 | 22 | 15 | ≦ Heptamer | 80 | 18 | 77 | 2 | 1 | 9 | x | Comparative Example |
| 2 | " | " | " | Octamer | 86 | 23 | 78 | 3 | 2 | 9 | Ⓐ | Example |
| 3 | " | " | " | Decamer | 88 | 25 | 79 | 4 | 3 | 9 | O | " |
| 4 | " | " | " | 14-mer | 89 | 25 | 79 | 4 | 3 | 9 | O | " |
| 5 | " | " | " | 30-mer | 89 | 25 | 79 | 4 | 3 | 9 | O | " |
| 6 | " | " | " | 40-mer | 87 | 24 | 77 | 2 | 2 | 9 | O | " |
| 7 | " | " | " | 45-mer | 87 | 24 | 73 | 1 | 1 | 9 | O | Comparative Example |
| 8 | 80 | 20 | — | ≦ Heptamer | 82 | 19 | 75 | 2 | 1 | 8 | x | Comparative Example |
| 9 | " | " | — | Octamer | 87 | 24 | 76 | 3 | 2 | 8 | Ⓐ | Example |
| 10 | " | " | — | Decamer | 88 | 25 | 77 | 4 | 3 | 8 | O | Example |
| 11 | " | " | — | 14-mer | 89 | 26 | 77 | 4 | 3 | 8 | O | " |
| 12 | " | " | — | 30-mer | 89 | 26 | 77 | 4 | 3 | 8 | O | " |
| 13 | " | " | — | 40-mer | 88 | 25 | 76 | 2 | 2 | 8 | O | " |
| 14 | " | " | — | 45-mer | 88 | 25 | 71 | 1 | 1 | 8 | O | Comparative Example |

EXAMPLE 2

Six samples of coated paper according to this invention were prepared in the same manner as in Example 1, except that 6 types of modified styrene-butadiene copolymer shown in Table 2 were used. The physical properties were as shown in Table 2.

TABLE 2

| Sample No. | Proportion of each constituent in copolymer (% by weight) | | | Styrene block | Coated paper | | | | | | | Remarks |
|---|---|---|---|---|---|---|---|---|---|---|---|---|
| | Styrene | Butadiene | Methyl methacrylate | | Paper gloss (%) 75° | Paper gloss (%) 20° | Ink gloss (%) | Surface strength Dry | Surface strength Wet | Smoothness (mmHg) | Stain on gloss calender | |
| 15 | 50 | 35 | 15 | 27-mer | 86 | 23 | 78 | 5 | 4 | 9 | O | Example |
| 16 | 55 | 30 | " | " | 88 | 25 | 79 | 5 | 3 | 9 | O | " |
| 17 | 60 | 25 | " | " | 89 | 25 | 79 | 4 | 3 | 9 | O | " |
| 18 | 80 | 5 | " | " | 89 | 26 | 77 | 2 | 2 | 9 | O | " |
| 19 | 75 | 10 | " | " | 88 | 25 | 76 | 3 | 2 | 9 | O | " |
| 20 | 70 | 15 | " | " | 87 | 24 | 76 | 3 | 3 | 9 | O | " |

EXAMPLE 3

Four samples of coated paper according to this invention were prepared in the same manner as in Example 1, except that 4 types of styrene-butadiene copolymer shown in Table 3 were used. The physical properties were as shown in Table 3.

TABLE 3

| Sample No. | Proportion of each constituent in copolymer (% by weight) Styrene | Butadiene | Methyl methacrylate | Styrene block | Coated paper: Paper gloss (%) 75° | 20° | Ink gloss (%) | Surface strength Dry | Wet | Smoothness (mmHg) | Stain on gloss calender | Remarks |
|---|---|---|---|---|---|---|---|---|---|---|---|---|
| 21 | 92 | 8 | — | 40-mer | 89 | 27 | 77 | 2 | 2 | 7 | O | Example |
| 22 | 88 | 12 | — | " | 89 | 27 | 77 | 3 | 2.5 | 7 | O | " |
| 23 | 58 | 42 | — | Nonamer | 82 | 20 | 76 | 5 | 5 | 9 | Δ | " |
| 24 | 62 | 38 | — | " | 84 | 21 | 76 | 5 | 5 | 9 | (Δ) | " |

What is claimed is:

1. A coated paper comprising a base paper and, provided thereon, a coating layer containing a latex and a paper-coating pigment, which is characterized in that said latex is a latex of a styrene-butadiene block copolymer wherein the proportions of styrene and butadiene are 60–92% by weight and 8 to 40% by weight, respectively, or modified styrene-butadiene copolymer wherein the copolymer is a copolymer of styrene, butadiene, and an acrylic or methacrylic ester wherein the proportions contained in the modified styrene-butadiene copolymer are 55 to 85% by weight, 10–40% by weight, and 5 to 35% by weight, respectively, the styrene block of which is composed of 8 to 40 monomeric units.

2. A coated paper according to claim 1, wherein the styrene block is composed of 10 to 30 monomeric units.

3. A coated paper according to claim 1, wherein the proportions of styrene and butadiene contained in the styrene-butadiene copolymer are 60 to 90% by weight and 10 to 40% by weight, respectively.

4. A coated paper according to claim 3, wherein the styrene-butadiene copolymer is that reacted with an acid monomer.

5. A coated paper according to claim 1, wherein the modified styrene-butadiene copolymer is a copolymer of styrene, butadiene and methyl methacrylate.

6. A coated paper according to claim 5, wherein the modified styrene-butadiene copolymer is that reacted with an acid monomer.

7. A coated paper according to claim 1, wherein the paper-coating pigment is an inorganic pigment.

8. A coated paper according to claim 7, wherein the inorganic pigment is kaolin.

9. A coated paper according to claim 7, wherein the inorganic pigment is a mixture of 90 parts by weight of kaolin and 10 parts by weight of precipitated calcium carbonate.

10. A coated paper according to claim 7, wherein the inorganic pigment is calcium carbonate.

11. A coated paper according to claim 1, wherein the paper-coating pigment is a mixture of an inorganic pigment and a plastic pigment.

12. A method for manufacturing a coated paper, which comprises coating a base paper with an aqueous coating composition containing a paper-coating pigment and a latex of a styrene-butadiene block copolymer wherein the proportions of styrene and butadiene are 60–92% by weight and 8 to 40% by weight, respectively, or a modified styrene-butadiene block copolymer wherein the copolymer is a copolymer of styrene, butadiene, and an acrylic or methacrylic ester wherein the proportions contained in the modified styrene-butadiene copolymer are 55 to 85% by weight, 10–40% by weight, and 5 to 35% by weight, respectively, the styrene block of which is composed of 8 to 40 monomeric units, drying the resulting wet coated paper, and treating the coated side by a heated calender.

13. A method for manufacturing a coated paper according to claim 12, wherein the heated calender is a gloss calender.

* * * * *